United States Patent [19]

Williams

[11] Patent Number: 4,740,020

[45] Date of Patent: Apr. 26, 1988

[54] MULTIPLE-STEP RELEASE LOCK FOR A STORAGE CONTAINER

[75] Inventor: James E. Williams, Stamford, Conn.

[73] Assignee: Cuisinarts, Inc., Greenwich, Conn.

[21] Appl. No.: 918,937

[22] Filed: Oct. 15, 1986

[51] Int. Cl.[4] ..... E05C 1/16

[52] U.S. Cl. ..... 292/41; 24/634; 24/657; 70/289; 292/302

[58] Field of Search ..... 292/41, 33, 37, 40, 292/156, 302, 45, 49, 52, 53, 25, 27, 29, 30, 157, 159, 161; 70/289; 24/634, 635, 657

[56] References Cited

U.S. PATENT DOCUMENTS

| | | | |
|---|---|---|---|
| 259,601 | 6/1882 | Swanson | 292/30 |
| 349,295 | 9/1886 | Alvovd | 292/49 |
| 360,064 | 3/1887 | Timby | 292/25 |
| 530,862 | 12/1894 | Teed | 70/289 |
| 1,179,712 | 4/1916 | Fournier | 292/156 |
| 1,377,737 | 5/1921 | Stosech | 70/289 |
| 1,414,862 | 5/1922 | Colavita | 292/40 X |
| 2,122,612 | 7/1938 | Knapp | 292/33 |
| 2,293,363 | 8/1942 | Schell | 292/302 |

FOREIGN PATENT DOCUMENTS

| | | | |
|---|---|---|---|
| 15491 | 10/1881 | Fed. Rep. of Germany | 292/33 |
| 1347862 | 11/1963 | France | 292/37 |
| 99476 | 6/1923 | Switzerland | 292/49 |
| 376475 | 7/1932 | United Kingdom | 292/29 |

*Primary Examiner*—Lloyd A. Gall

*Attorney, Agent, or Firm*—Parmelee, Bollinger & Bramblett

[57] ABSTRACT

A cover is manually releasably locked to the base of a storage container for protecting the contents of the container from accidentally or inadvertently opening even on dropping. A forked member is mounted on the cover having tongues with eyelets extending downwardly therefrom which fit into a latch housing in the base which contains slots for receiving the eyelet tongues. A slidable actuator is movably mounted in the latch housing which housing includes a first and second latch which are adapted to engage the eyelets of the tongues of the stem when the cover is closed on the container. Spring means are provided for urging the first and second latches into the eyelets which are released by a multiple-step technique in which the actuator is moved in a first direction for removing the first latch from one of the eyelets and then moved in a second opposite direction which removes the second latch from the other eyelet, and by gently, continuously and evenly lifting the cover upwardly while the latches are being released in sequence. If the actuator is moved too far in the second direction, a third latch engages for preventing opening. If the continuous lifting force on the cover is too strong the lock cannot be opened. If the gentle continuous lifting force is uneven or interrupted one of the latches becomes engaged by the spring means for preventing opening, thereby preventing the accidental or inexperienced, unauthorized opening of the container.

9 Claims, 3 Drawing Sheets

MULTIPLE-STEP RELEASE LOCK FOR A STORAGE CONTAINER

BACKGROUND

This invention relates to a manually operable locking means for releasably locking a cover to the base of a storage container, and more particularly, to a multiple-step release lock for a storage container which prevents the accidental or inexperienced, unauthorized opening of the container which is designed to protect various accessories and implements, for example, of the type illustrated in food processors, or from the inadvertent injury to the user in the storage of such devices.

Many appliances which are adapted to perform a number of functions using a variety of different attachments and tools can provide storage problems for the safe and convenient storage and handling of the attachments and the different tools. For example, food processors which have become very popular kitchen appliances have a variety of accessories and implements some of which contain sharp blades which cannot be conveniently stored on a shelf because of their non-conventional size, shape or configuration. For example, one such cutting or chopping tool is characterized by having two crescent-shaped metal blades mounted on opposite sides of a hub having a socket therein which is adapted to fit on a vertical drive shaft of a motor drive of a food processor. The blades are characterized by sharp leading edges and so must be handled and stored carefully to avoid damage to the metal blades and possible inadvertent injury to the user. A storage container for food processor rotary tools is described and claimed in my co-pending application Ser. No. 918,938 which conveniently and safely stores such implements.

It is desirable for storage containers of the aforesaid type to have a drop-proof manually operated engagement of the cover on the container to prevent the accidental or unauthorized opening of the container so as to assure protection for the user with respect to the implements stored therein as well as assuring protection from the sharp cutting edges of the metal blade of the implement stored. Accordingly, even if the storage container is dropped, the container will not open and damage the tools or injure the user. The purpose in providing a manually operated lock would be to have latch means which is simple and does not proliferate the already considerable number of keys required to maintain and operate a household. Such a locking structure should also be simple, easy to operate for one knowledgeable in such operation and not mechanically complex or expensive.

SUMMARY OF THE DISCLOSURE

Accordingly, it is an object of this invention to provide a new and improved manually operable drop-proof lock for a storage container for example, of the type for storing rotary tools and accessories for a food processor.

A further object of this invention is to provide a new and improved multiple-step release lock for a storage container which is simple mechanically, relatively easy to operate for one knowledgeable in the operation and inexpensive to implement.

Still another object of this invention is to provide a new and improved multiple-step release lock for a storage container which is accident-proof and will not open even though the container is accidentally dropped.

In carrying out this invention in one illustrative embodiment thereof, a multiple-step release lock for a storage container for manually releasably locking a cover to the base of a storage container is provided to protect the contents of the container as well as the user from accidental, inadvertent or unauthorized opening of the container. A forked member having first and second tongues thereon is mounted on the cover with the first and second tongues having ends thereof extending downwardly from the cover. First and second eyelets provided in the ends of the first and second tongues respectively, are adapted to fit in a latch housing mounted on the base of the container having first and second slots which releasably receive the first and second tongues of the cover when the cover is closed on the container. First and second latching means are provided in the housing for engaging the first and second eyelets,respectively, in the first and second tongues on the cover for holding the cover in a locked position on the base when the cover is closed on the container. In starting to open the lock, the user applies a gentle, continuous upward lifting force on the cover near the lock so that this lifting is centrally and evenly applied. A slidable actuator is movably mounted in the housing and has means for coupling the actuator to the first latching means for disengaging the first latching means from said first eyelet on slidable movement of the actuator in the first direction and has a second means coupling the actuator to the second latching means for disengaging the second latching means from the second eyelet on slidable movement of the actuator by a predetermined amount but not too far in a second direction, whereby only after a predetermined sequential movement of the actuator in the latch housing can the cover be disengaged from the storage container, thereby preventing the accidental or inexperienced, unauthorized opening of the storage container.

By virtue of the fact that the actuator must be moved in two opposite directions in sequence and also must not be moved too far in the second direction, while a continuous, gentle, centrally applied and even lifting force is being exerted on the cover, it is very unlikely that the latching means can inadvertently be released by dropping the container or by a child. In fact, several adults who are experienced and competent in handling engineering-type matters have been handed the container in closed locked condition. These adults have unsuccessfully fumbled with the two-step release for several minutes in attempting to open the container and have finally given up the attempt with frustration, asking to be shown the "secret" of how to open this lock.

BRIEF DESCRIPTION OF THE DRAWINGS

The invention, together with further objects, features, advantages and aspects thereof may be more clearly uhderstood from the following description taken in connection with the accompanying drawings in which like elements are designated with like reference numerals throughout the various views.

DESCRIPTION OF THE PREFERRED EMBODIMENTS

Figure 1:
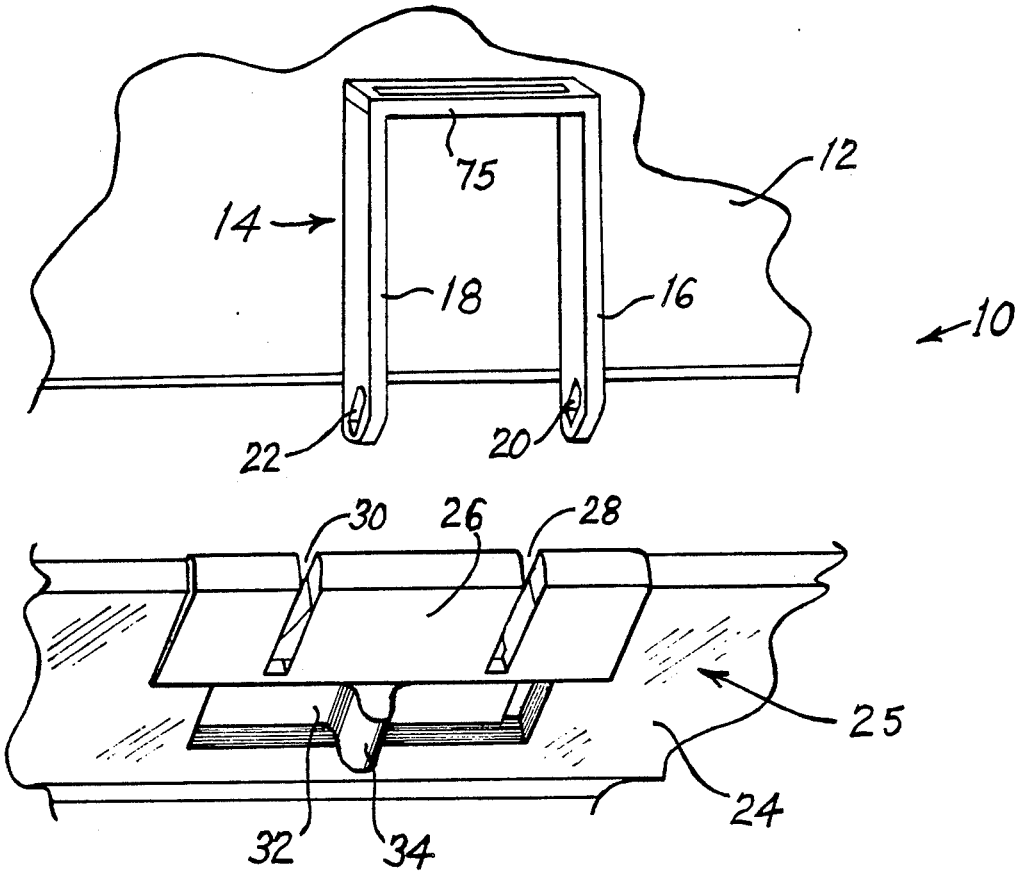
FIG. 1 is a perspective view of the multiple-step release lock for a container, with a partial showing of the cover and the base of the container in an open position.
Figure 2:
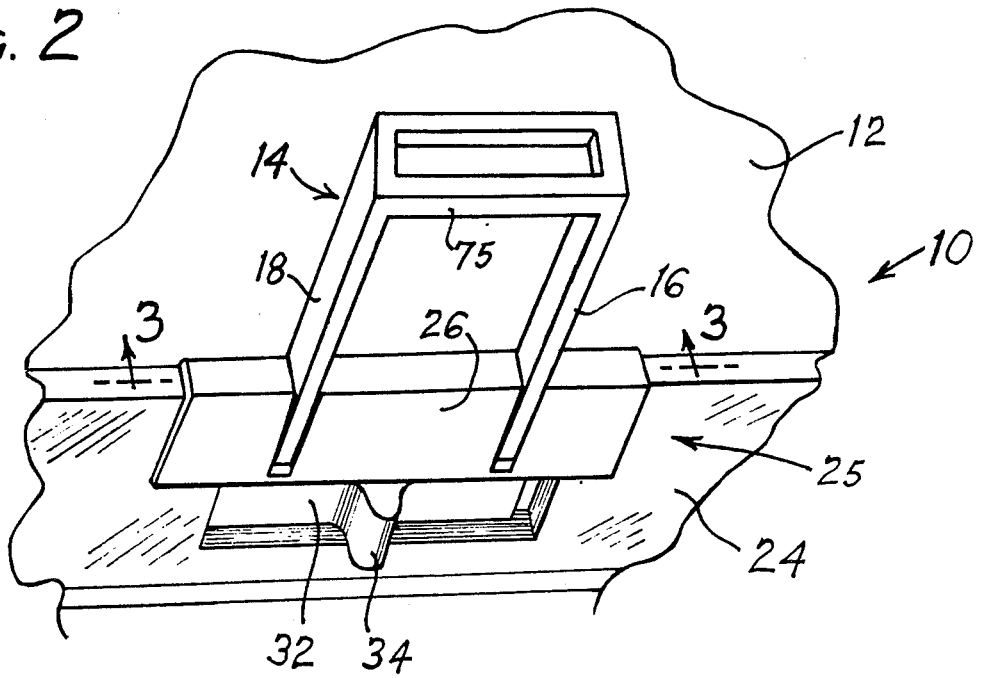
FIG. 2 is a view similar to FIG. 1 illustrating the cover fully closed and in a locked position on the base of the container in accordance with the present invention.

Referring now to FIG. 1, a storage container, indicated generally by the reference numeral 10 is only partially shown, including a cover 12 having a two-prong forked member 14 mounted thereon which has first and second tongues 16 and 18 projecting therefrom and having in the ends thereof eyelets 20 and 22, respectively. A base 24 for the storage container 10 includes a latch housing 26 of the multiple-step release lock 25. This housing 26 has first and second slots 28 and 30 therein which are spaced and parallel in said latch housing 26 and are adapted to receive the tongues 16 and 18, respectively, from the forked member 14 when the cover 12 is closed on the latch housing 26 as shown in FIG. 2. A slidable actuator 32 having a forwardly projecting actuator button or knob or bar 34 positioned centrally thereon is slidably mounted in said latch housing 26 as will be explained hereinafter.

Figure 3:
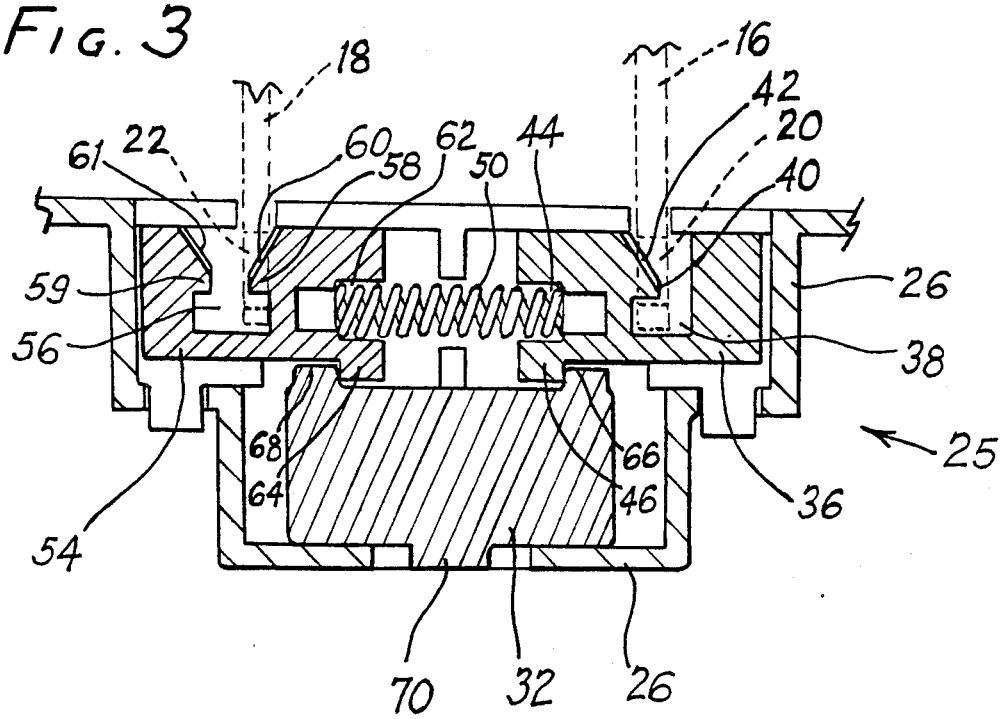
FIG. 3 is an elevational sectional view of the multiple-step release lock of the present invention illustrating the cover tongues in dashed outline being locked in the base of the latch housing in accordance with the present invention.

Referring now to FIG. 3, the latch housing 26 includes a first movable latch 36 having a downwardly extending cavity 38 therein into which protrudes a nose-shaped projection 40 having a downwardly inclined ramp 42 thereon. The cavity 38 is adapted to receive the tongue 16 of the forked member 14 on the cover 12 when the cover is closed on the base 24. When the cover is closed, the eyelet 20 on the end of the tongue 16 is adapted to receive the projection 40 for retaining the cover 12 latched onto the base 24. The first latch 36 includes a horizontal socket 44 therein and an outer shoulder 46 thereon adapted to be engaged by the actuator 32 for moving this first latch 36. The socket 44 receives and holds an end of a compression spring 50.

A second latch 54 is horizontally aligned in said latch housing 26 with said first latch 36 and has a downwardly extending cavity 56 therein adapted to receive the second tongue 18 of the forked member 14 mounted on the cover 12. The second latch 54 includes a second nose-shaped projection 58 having a downwardly inclined sloping ramp 60 thereon which slopes at a downward inclination opposite to the direction of the downward inclination of the ramp 42 on the projection 40 of the latch 36. The projection 58 is adapted to enter the eyelet 22 of the second tongue 18 for holding the tongue 18 securely until released. The second latch 54 includes a socket 62 for receiving and holding the other end of the compression spring 50 within the latch housing 26. The second latch 54 also includes an outer shoulder 64 which is adapted to be engaged by the actuator 32 for moving the latch 54 in the housing 26.

There is a third nose-shaped projection 59 with a ramp 61 on the second latch 54 which makes the "secret" technique for opening this multiple-step release lock 25 more difficult to find out by trial and error or to open by accidental dropping of the container.

The actuator 32 includes a first inner shoulder 66 adapted to engage the outer shoulder 46 of the first latch 36 by moving the actuator 32 in a first direction. The actuator 32 also includes on the opposite side thereof a second inner shoulder 68 which is adapted to engage the outer shoulder 64 of the second latch 54 for moving this second latch in the housing 26. The actuator 32 also includes a stop 70 which slidably moves in a slot in the housing 26 to effectively limit the slidable movement of the actuator 32 within this housing.

Figure 4:
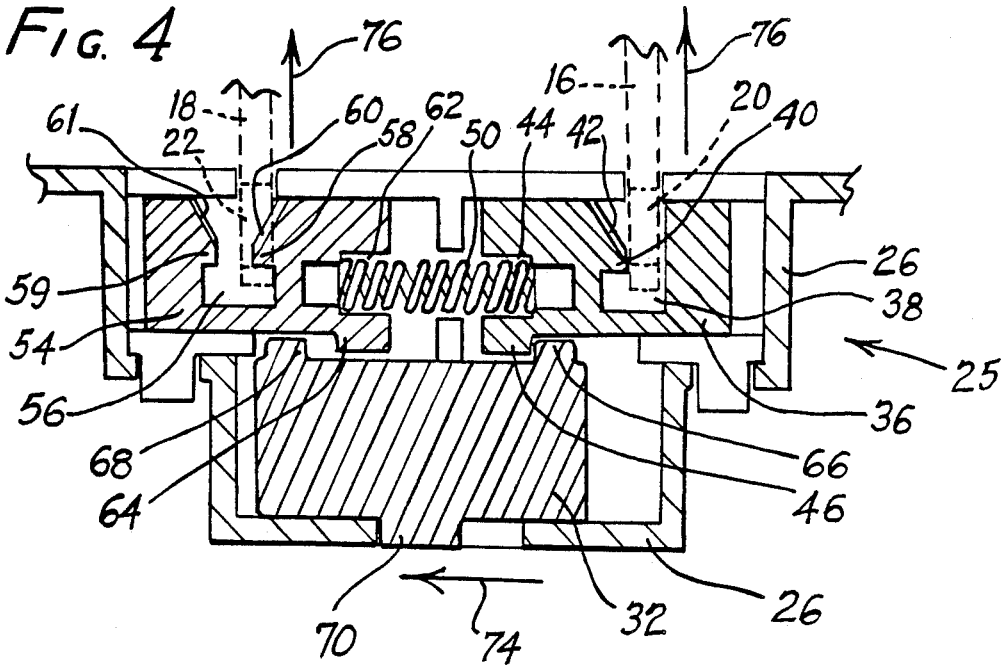
FIG. 4 is a view similar to FIG. 3 illustrating a step for opening the multiple-step release lock in accordance with the present invention.

In describing the operation of the multiple-step release lock 25 in accordance with the present invention, reference is first made to FIG. 4 which illustrates the actuator 32 being moved to the left as illustrated by arrow 74, while at the same time the user is applying a continuous mild upward force to the horizontal ledge 75 on the lock member 14 on cover 12 as illustrated by the arrows 76. Moving the actuator 32 left in the direction of the arrow 74 brings the inner shoulder 66 of the actuator 32 into contact with the outer shoulder 46 on the first latch 36 for moving this latch to the left against the force of the compression spring 50 for withdrawing the projection 40 from the eyelet 20 in the first tongue 16.

It is to be noted in FIG. 1 that the eyelet 22 in the second latch tongue 18 is longer than the first eyelet 20. Thus, this second eyelet 22 extends down farther, nearer to the lower end of its tongue 18, than the first eyelet 20. Consequently, once the projection 40 has been withdrawn from the first eyelet 20 the gentle manual upward force indicated by the arrow 76 easily pulls the first tongue 16 slightly upwardly in the slot 28 (FIG. 2), while the projection 40 rides along the side of the withdrawn tongue 16 in the manner illustrated in FIG. 4.

Accordingly, when the actuator button 34 (FIG. 2) is then released, the spring 50 attempts to return the actuator 32 to its initial position, but the nose projection 40 merely is bumping against the side surface of the first tongue 16 below the location of the first eyelet 20. The first tongue 16 has been released from the locking engagement of the nose projection 40 in the first eyelet 20.

In summary so far: the "secret" technique for beginning to open this multiple-step release lock 25 involves these manipulations:

(a) A continuous, gentle (not too strong) upward lifting force (arrows 76, FIG. 4) is applied to the ledge 75 (FIG. 2) on the cover.

(b) The actuator button 34 is then moved in a first predetermined direction, namely, to the left away from its initial central position, as shown by the arrow 74 (FIG. 4) for withdrawing the first latch projection 40 from the first eyelet 20.

(c) The manual lifting force 76 causes the first tongue 16 (now released by the withdrawn projection 40) to be lifted up slightly in the slot 28 so that the eyelet 20 is raised slightly above the level of the nose of the projection 40. Thus, the projection 40 cannot re-enter the eyelet 20.

(i) The longer second eyelet 22 in the second tongue 18 provides clearance to permit this slight lifting of the first tongue, because the whole cover and the second tongue also become slightly lifted by the continuous manual force 76.

(ii) If the upward lifting force 76 is not continued, the cover will drop back, and the projection 40 will be able to re-enter the eyelet 20, when the actuator 32 is released.

(d) The actuator button 34 is now released, allowing the spring 50 to slide the actuator back toward its initial centralized position, but the projection 40 cannot re-enter the first eyelet 20 in the slightly lifted first tongue 16 which remains lifted by the user continuing to apply gentle lifting force.

(e) The hook-like overhang of the projection 40 makes the latch 36 difficult or impossible to release from the eyelet 20 if too strong a lifting force 76 is applied to the ledge 75.

Figure 5:
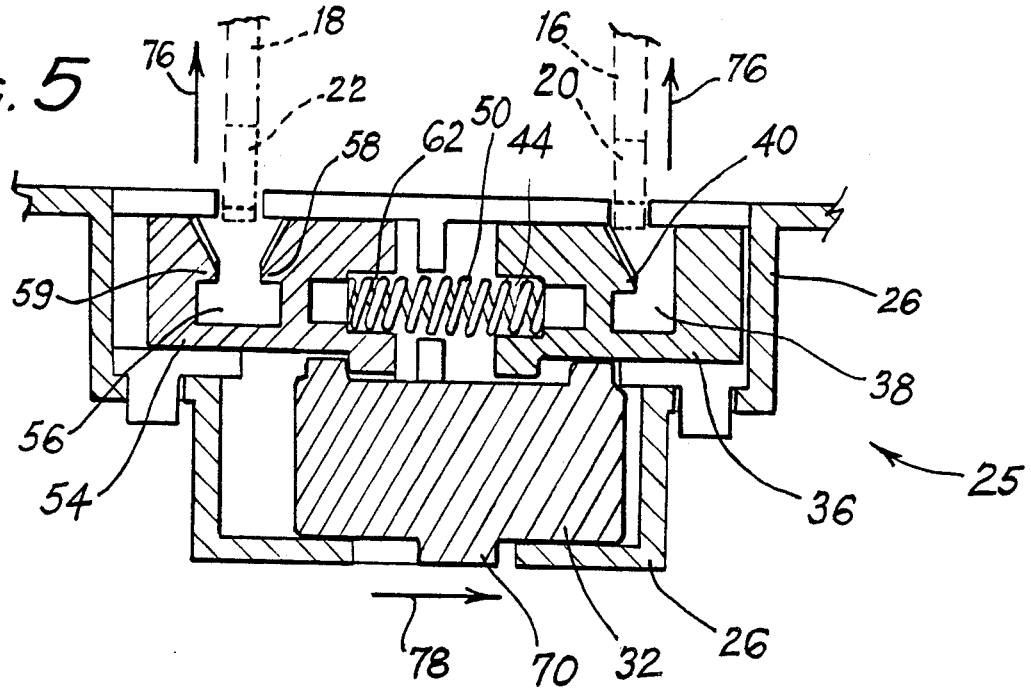
FIG. 5 is a view similar to FIGS. 3 and 4 illustrating a later step in the release of the latching mechanisms in accordance with the present invention.
Figure 6:
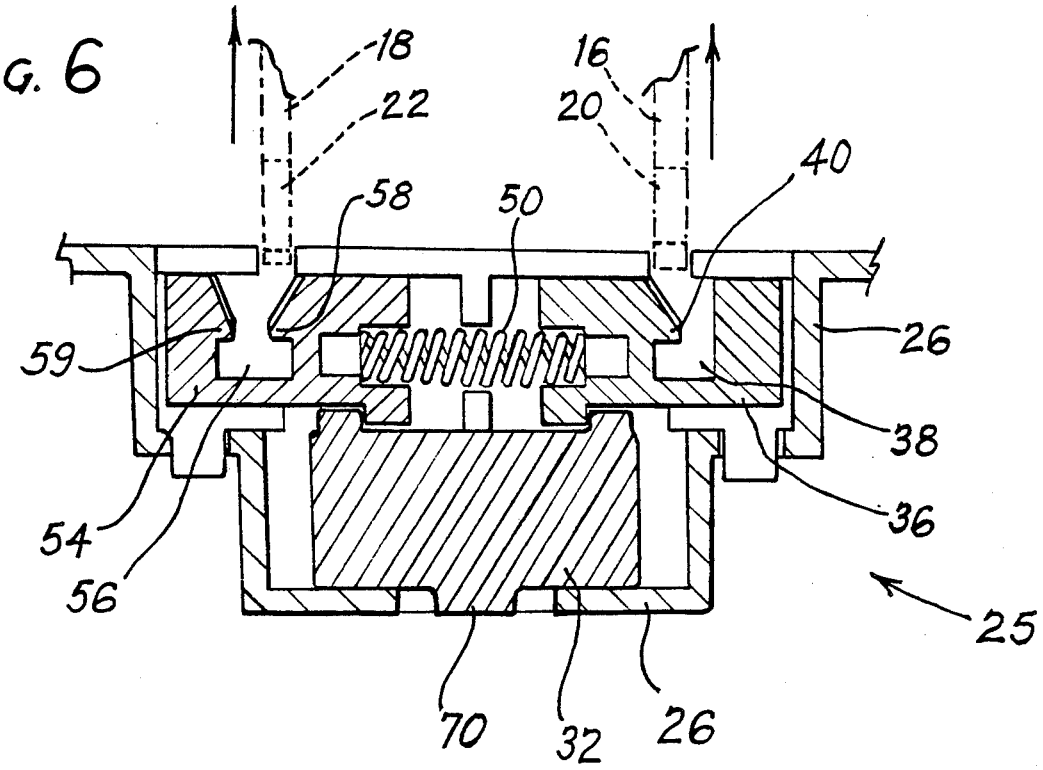
FIG. 6 is a view similar to FIG. 3 showing the cover having been completely released from the latching mechanism.

In the next step, as illustrated in FIG. 5, the actuator 32 is pushed only part way in the opposite direction as illustrated by the arrow 78 while lifting force is continuing to be exerted on the ledge 75 as illustrated by the arrows 76. Moving the actuator 32 to the right as shown by the arrow 78 in FIG. 5 brings the inner shoulder 68 of the actuator 32 into contact with the outer shoulder 64 of the second latch 54 for moving the latch 54 to the right for withdrawing the projection 58 from the elongated eyelet 22 in the second tongue 18, which at the same time is being lifted upwardly in the direction of the arrows 76. As will now be seen in FIG. 6, both tongues 18 and 16 have been released in the multiple-step operation just described, thereby unlocking the cover 12 from the base of the container 24.

The second latch 54 includes a third nose-shaped projection 59 which enters the second eyelet 22 if the actuator 32 is moved fully to the end of its rightward travel 78. In other words, this actuator 32 must be moved only so far as a predetermined position whereat both of the latching projections 58 and 59 are clear of the eyelet 22. An over-eager rightward movement of the actuator 32 is frustratingly self-defeating in trial and error attempts to open this lock by a person who does not know the "secret" technique.

In summary of the concluding manipulations for opening the lock 25:

(f) After having allowed the spring 50 to return the actuator 32 toward its initial centralized position, and while continuing to exert the lifting force 76 gently and evenly applied, the button is now moved in the opposite direction, namely to the right, (but not too far) to a predetermined position where both of the projections 58 and 59 are clear of the second eyelet 22 so that the gentle lifting force 76 can now fully withdraw both of the tongues 16 and 18 from their respective slots 28 and 30 in the lock 25.

(g) If the actuator button 34 is moved too far in the second direction 78, then a third projection 59 on the second latch 54 enters the second eyelet for preventing opening of the lock.

The inclined ramps 42, 60 and 61 on the three latching projections 40, 58 and 59 facilitate smooth entry of the tongues 16 and 18 down into their respective slots 28 and 30, in the event that the user is manually displacing the actuator button 34 away from its normal initial centralized position in the housing 26 against the force of the spring 50 while at the same time closing the cover.

This multiple-step release of locking operation is simple, yet effective in preventing the accidental or inadvertent opening of the container 10 by the accidental dropping of the container or by an operator who does not know how it works. Accordingly, the contents are protected from spilling out and being damaged if the container is accidentally dropped, because the lid cannot be jarred open, and at the same time this novel lock prevents unauthorized opening by persons who are unfamiliar with the locking mechanism. This multiple-step locking mechanism is accomplished mechanically with one spring plus simple, inexpensive molded parts which are easy to fabricate and assemble and are considerably less expensive than providing locks requiring keys or other elaborate mechanisms.

The lock 25 is particularly suitable for the type of storage container claimed in the aforesaid application for protecting tools and accessories of a food processor.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

What is claimed is:

1. A multiple-step release lock for a storage container for manually releasably locking a cover to the base of a storage container to protect the contents of the container as well as the user from accidental, inadvertent or unauthorized opening of the container comprising:

a lock member having first and second tongues for mounting on said cover with said first and second tongues having ends thereon extending downwardly from said cover, first and second eyelets in said ends of said first and second tongues, respectively, a latch housing mounted on said base of said container and having first and second spaced slots therein adapted to receive and releasably hold said first and second tongues therein when the cover is closed on the container, a slidable actuator movably mounted in said latch housing, first and second latching means in said latch housing for engaging said first and second tongues on said cover for holding the cover in a locked position on the base when said cover is closed on said container, first means coupling said actuator and said first latching means for moving said first latching means for disengaging said first latching means from said first eyelet on slidable movement of said actuator in a first direction, and second means coupling said actuator and said second latching means for moving said second latching means for disengaging said second latching means from said second eyelet on slidable movement of said actuator in a second direction opposite to said first direction, whereby only after predetermined movements of said actuator in said latch housing is the cover disengaged from the base of said storage container for allowing the container to be opened, thereby preventing the accidental or inexperienced, unauthorized opening of said storage container.

2. The multiple-step release lock as claimed in claim 1, wherein:

said first and second latching means have first and second cavities therein, respectively aligned with said first and second slots in said housing, said first latching means having a first nose-shaped projection extending into said first cavity adapted to fit into and engage in said first eyelet, said second latching means having a second nose-shaped projection extending into said second cavity adapted to fit into and engage in said second eyelet, and said first and second nose-shaped projections facing away from each other in opposite directions.

3. The multiple-step release lock as claimed in claim 2, having a compression spring positioned between said first and second latching means for urging said first and second nose-shaped projections into said first and second eyelets, respectively, when said first and second tongues have been inserted through said first and second slots into said first and second cavities, respectively.

4. The multiple-step release lock as claimed in claim 1, wherein:

said first and second means coupling said actuator and said first and second latching means comprises an outwardly extending shoulder on each of said first and second latching means engageable by first and second inwardly extending shoulders on said actuator, said first shoulder on said actuator being engageable with said outwardly extending shoulder on said first latching means during the slidable movement of said actuator in said first direction, and said second shoulder on said actuator being engageable with said outwardly extending shoulder on said second latching means during the slideable movement of said actuator in said second direction.

5. The multiple-step release lock as claimed in claim 4, having compression spring means positioned between said first and second latching means for urging said first and second latching means away from each other in said latch housing.

6. A multiple-step release lock for a storage container for manually releasably locking a cover to the base of a storage container to protect the contents of the container as well as the user from accidental, inadvertent or unauthorized opening of the container comprising:

a lock member having first and second tongues for mounting on said cover with said first and second tongues having ends thereon extending downwardly from said cover, first and second eyelets in said ends of said first and second tongues, respectively, a latch housing mounted on said base of said container and having first and second spaced slots therein adapted to receive and releasably hold said first and second tongues therein when the cover is closed on the container, a slidable actuator movably mounted in said latch housing, first and second latching means in said latch housing for engaging said first and second tongues on said cover for holding the cover in a locked position on the base when said cover is closed on said container, first means coupling said actuator and said first latching means for moving said first latching means for disengaging said first latching means from said first eyelet on slidable movement of said actuator in a first direction, second means coupling said actuator and said second latching means for moving said second latching means for disengaging said second latching means from said second eyelet on slidable movement of said actuator in a second direction opposite to said first direction, said first and second latching means having first and second cavities therein, respectively aligned with said first and second slots in said housing, said first latching means having a first nose-shaped projection extending into said first cavity adapted to fit into and engage in said first eyelet, said second latching means having a second nose-shaped projection extending into said second cavity adapted to fit into and engage in said second eyelet, and said first and second nose-shaped projections facing away from each other in opposite directions, and said second latching means having a third nose-shaped projection extending into the cavity in said second latching means on the opposite side of said cavity from said second nose-shaped projection for said third nose-shaped projection to engage in said second eyelet for retaining the second tongue in the cavity in said second latching means if the actuator is moved beyond a predetermined position in said second direction, whereby only after predetermined movements of said actuator in said latch housing is the cover disengaged from the base of said storage container for allowing the container to be opened, thereby preventing the accidental or inexperienced, unauthorized opening of said storage container.

7. A multiple-step release lock comprising:

a latch member having first and second spaced parallel tongues, said first tongue having a first eyelet therein, said second tongue having a second eyelet therein, a latch housing having first and second movable latch means therein, said first latch means having a first projection, said second latch means having a second projection, said first and second projections being engageable into said eyelets, said housing having openings for allowing said first and second tongues to be inserted into said housing into proximity with said first and second latch means, respectively, for closing the lock, spring means in said housing associated with first and second latch means for urging said first and second projections to enter said first and second eyelets, respectively establishing a locked relationship, manually operable actuator means movably mounted in said housing and said actuator means being operatively associated with said first and second latch means, said actuator means being manually movable in a first direction for acting against said spring means for withdrawing said first projection from said first eyelet for releasing said first tongue from said locked relationship, said second eyelet and second projection providing slight clearance for allowing said latch member to be moved slightly away from said housing for both of said tongues to be withdrawn slightly from said housing as soon as said first projection is withdrawn from said first eyelet for slightly moving said first eyelet for preventing said spring means from urging said first projection to re-enter said first eyelet for so long as said latch member is manually held slightly away from said latch housing, and said actuator means being manually movable in a second direction opposite to said first direction for acting against said spring means for withdrawing said second projection from said second eyelet for releasing said second tongue from locked relationship for allowing said latch member to be moved farther away from said latch housing for withdrawing said first and second tongues fully from the latch housing for fully opening the lock.

8. The multiple-step release lock claimed in claim 7, in which:

one of said latch means includes a pair of projections facing toward each other and spaced apart sufficiently for one of said tongues to move into a position between said pair of projections where the eyelet therein is aligned with said projections for causing said spring means to urge one projection of said pair into said eyelet, said actuator means being movable a predetermined amount for acting against said spring means for withdrawing said one projection from said eyelet for releasing said one tongue from locked relationship, and said actuator being movable beyond said predetermined amount for causing the other projection of said pair to enter said eyelet for reestablishing the locked relationship of said one tongue.

9. The multiple-step release lock claimed in claim 7, in which:

said second latch means includes a third projection facing in the opposite direction from said second projection and being spaced from said second projection sufficiently for allowing said second tongue to be inserted into said housing between said second and third projection, said actuator means being manually movable in said second direction for a predetermined distance for withdrawing said second projection from said second eyelet for releasing said second tongue from locked relationship, and said actuator means being manually movable beyond said predetermined distance for inserting said third projection into said second eyelet for reestablishing the locked relationship of said second tongue.

* * * * *